US010194719B2

(12) United States Patent
Li et al.

(10) Patent No.: US 10,194,719 B2
(45) Date of Patent: Feb. 5, 2019

(54) ENHANCED SLIDER

(71) Applicant: KEE (GUANGDONG) GARMENT ACCESSORIES LIMITED, Foshan (CN)

(72) Inventors: Qiulei Li, Foshan (CN); Tao Wang, Foshan (CN)

(73) Assignee: KEE (GUANGDONG) GARMENT ACCESSORIES LIMITED, Foshan (CN)

( * ) Notice: Subject to any disclaimer, the term of this patent is extended or adjusted under 35 U.S.C. 154(b) by 153 days.

(21) Appl. No.: 15/007,213

(22) Filed: Jan. 27, 2016

(65) Prior Publication Data

US 2016/0135552 A1 May 19, 2016

Related U.S. Application Data

(63) Continuation-in-part of application No. 14/093,400, filed on Nov. 29, 2013, now abandoned, which is a continuation-in-part of application No. PCT/CN2013/072906, filed on Mar. 20, 2013.

(30) Foreign Application Priority Data

Aug. 4, 2012 (CN) ..... 2012 2 0387379 U

(51) Int. Cl.

| | |
|---|---|
| ***A44B 19/30*** | (2006.01) |
| ***A44B 19/26*** | (2006.01) |
| ***A44B 19/42*** | (2006.01) |

(52) U.S. Cl.

CPC ..... *A44B 19/308* (2013.01); *A44B 19/26* (2013.01); *A44B 19/262* (2013.01); *A44B 19/42* (2013.01); *Y10T 24/2577* (2015.01); *Y10T 29/49783* (2015.01)

(58) Field of Classification Search

CPC ..... A44B 19/303; A44B 19/42; A44B 19/308
See application file for complete search history.

(56) References Cited

U.S. PATENT DOCUMENTS

| | | | | |
|---|---|---|---|---|
| 4,287,646 A * | 9/1981 | Kanzaka | ..... | A44B 19/308 24/424 |
| 5,625,928 A * | 5/1997 | Terada | ..... | A44B 19/308 24/421 |
| 5,664,300 A * | 9/1997 | Mizuno | ..... | A44B 19/308 24/421 |
| 6,523,232 B2 * | 2/2003 | Chen | ..... | A44B 19/26 24/418 |

(Continued)

*Primary Examiner* — Jason W San
(74) *Attorney, Agent, or Firm* — Wayne & Ken, LLC; Tony Hom

(57) ABSTRACT

A zipper slider is provided. The zipper slider includes a slider body configured to slide along a zipper, the slider body having an upper wing with a top surface. The zipper slider also includes a pulling member integrally formed with the upper wing, the pulling member having at least one wall(s) on the upper wing each having a substantially closed aperture therethrough, wherein the at least one wall(s) is longitudinally disposed on the top surface of the upper wing and the at least one substantially closed aperture(s) forms a transverse channel. The zipper slider further includes a pull tab having a pintle, wherein the pintle is disposed in the transverse channel.

4 Claims, 10 Drawing Sheets

(56) References Cited

U.S. PATENT DOCUMENTS

| | | | | |
|---|---|---|---|---|
| 6,654,988 | B1 * | 12/2003 | Chung | A44B 19/308 24/419 |
| 6,993,810 | B2 * | 2/2006 | Hamada | A44B 19/308 24/422 |
| 7,257,869 | B2 * | 8/2007 | Lin | A44B 19/262 24/421 |
| 7,356,887 | B2 * | 4/2008 | Iwase | A44B 19/306 24/415 |
| 7,464,445 | B1 * | 12/2008 | Lin | A44B 19/308 24/415 |
| 7,650,674 | B2 * | 1/2010 | Miyazaki | A44B 19/308 24/424 |
| 7,870,650 | B2 * | 1/2011 | Keyaki | A44B 19/26 24/421 |
| 2002/0178552 | A1 * | 12/2002 | Lin | A44B 19/308 24/418 |
| 2004/0078942 | A1 * | 4/2004 | Hamada | A44B 19/308 24/436 |
| 2009/0094804 | A1 * | 4/2009 | Miyazaki | A44B 19/308 24/421 |
| 2009/0106952 | A1 * | 4/2009 | Lin | A44B 19/308 24/418 |
| 2011/0041297 | A1 * | 2/2011 | Iwase | A44B 19/306 24/418 |
| 2014/0033484 | A1 * | 2/2014 | Hamada | A44B 19/26 24/418 |
| 2016/0143401 | A1 * | 5/2016 | Miyazaki | A44B 19/308 24/420 |

* cited by examiner

ENHANCED SLIDER

CROSS REFERENCE TO RELATED APPLICATIONS

This application is a continuation-in-part of application Ser. No. 14/093,400, filed Nov. 29, 2013, now pending, which is a continuation-in-part of International Application Serial No. PCT/CN2013/072906 filed on Mar. 20, 2013, and further claims priority of Chinese Patent Application 201220387379.2, filed on Aug. 4, 2012. The content of the aforementioned applications, including any intervening amendments thereto, is incorporated herein by reference.

FIELD OF INVENTION

This invention generally relates to a slider and, more particularly to an enhanced slider.

BACKGROUND

Zipper is one of the most practical inventions of last century, and is extensively used in a wide range of trades and industries. Traditional sliders of zippers may be categorized into automatic locking and non-automatic locking type. An automatic locking slider usually includes a slider body, a pull tab, a locking lever, a plate spring, and a cover. The cover may be fixed to an upper wing of the slider, and attach the pull tab to the slider. The plate spring and the locking lever may be disposed within the cover. The locking lever may receive pressing force generated by the plate spring. Under the force, a locking prong of the locking lever may pass a locking opening on the upper wing to be disposed in the space between two zipper teeth to lock the slider in a position. The pull tab may lift the locking leer when it is pulled. The locking prong may be subsequently removed from between zipper teeth to release the locking of the slider to allow the movement of the slider on zipper. Traditionally, the locking lever, the plate spring and the cover are manufactured by press riveting. The slider body and the cover containing the plate spring and locking lever are also manufactured by press riveting. The manufacturing of a slider is complex and the efficiency is low due to the press riveting and the riveting force is not enough high. In addition, a cover riveting apparatus is required for the press riveting, which increases the production costs of a zipper slider. Even more, there exists the risk that the riveted cover falls off due to inadequate riveting. Tests have shown that the composite pulling force of the slider body and the pull tab of the zipper slider is not stable.

The disclosed slider is directed at solving one or more problems set forth above and other problems.

BRIEF SUMMARY OF THE DISCLOSURE

One aspect of the present disclosure provides a zipper slider. The zipper slider includes a slider body configured to slide along a zipper, the slider body having an upper wing with a top surface. The zipper slider also includes a pulling member integrally formed with the upper wing, the pulling member including at least one wall(s) each having a substantially closed aperture therethrough, wherein the at least one wall(s) is longitudinally disposed on the top surface of the upper wing and the at least one substantially closed aperture(s) forms a transverse channel. The zipper slider further includes a pull tab having a pintle, wherein the pintle is disposed in the transverse channel. In usage, the pintle of the pull tab is coupled to the aperture(s) of the wall(s) when a pulling force is exerted on the pull tab such that the wall(s) receive(s) the whole pulling force due to the substantially closed aperture. With respect to the zipper slider of the present invention, due to the integral structure of the pull member with the slider body, the composite pulling force of the slider body and the pull tab of the zipper slider is more stable and the bearable pulling force of the zipper slider is substantially increased, when compared to the traditional zipper slider having the riveted cover. In addition, the production costs of the inventive zipper slider are reduced due to the cancellation of the press riveting apparatus.

In one embodiment, the pulling member is integrally molded on the top surface of the upper wing. Since the pulling member is integrally formed with the upper wing, it can bear a greater pulling force applied by the pull tab. Such zippers can be used in clothing (jackets, outdoor jackets, down-filled clothes etc.), tents, cases and bags, shoes and other fields.

In one embodiment, the zipper slider includes two walls and further comprises an assembly groove longitudinally formed between the two walls above the top surface of the upper wing and a cap configured to cover the assembly groove, the cap being detachably and/or replaceably attached to the pulling member without using press riveting. The cap can be provided on its top surface with decorations, e.g. decorative colors or patterns. In usage, the pintle of the pull tab is coupled to the apertures of the walls when a pulling force is exerted on the pull tab such that the walls receives the whole pulling force due to the substantially closed apertures but the cap receives no pulling force.

In one embodiment, the zipper slider further comprises a locking lever having a pivot end and a locking prong; a plate spring, wherein the plate spring contacts the locking lever and exerts a force on the locking lever; a chamber disposed in the assembly groove: and a locking opening in the upper wing between the two walls, wherein the locking lever is so configured that the pivot end is disposed in the chamber and the locking prong penetrates the locking opening to be disposed between two zipper teeth when the pull tab is n a resting state, and the locking prong is lifted against the force exerted by the plate spring to disengage from the zipper teeth when a pulling force is exerted on the pull tab.

In one embodiment, the zipper slider comprises a first platform disposed close to a front end of the assembly groove and a second platform disposed close to a rear end of the assembly groove. The first platform has a first receiving structure and the cap has a first attaching member, the second platform has a second receiving structure and the cap has a second attaching member, wherein the first receiving structure and the first attaching member as well as the second receiving structure and the second attaching member interact to attach the cap to the pulling member, so that the cap can be snapped into the assembly groove. The zipper slider further comprises a first protruding block disposed on the first platform and a second protruding block disposed on the second platform, and a first receiving member on the cap to correspond to the first protruding block and a second receiving member on the cap to correspond to the second protruding block.

In one embodiment, the traverse channel has a first and a second cross transverse walls inclining outwardly from the bottom to the top so that the traverse channel has a cross section with a small bottom and a larger top. In this way, it is easier to lift the locking lever when pulling the pull tab so as to disengage the locking prong from the zipper teeth.

Another aspect of the present disclosure provides a process of making a zipper slider. The process includes the following steps of: providing a slider body configured to slide along a zipper, the slider body having a pulling member integrally formed with the upper wing, the pulling member including at least one wall(s) each having a substantially closed aperture there through, wherein the at least one wall(s) is longitudinally disposed on the top surface of the upper wing and the at least one substantially closed aperture(s) forms a transverse channel; and providing a pull tab with a pintle and disposing the pintle in the transverse channel.

In one embodiment, the pulling member includes two walls and an assembly groove is longitudinally formed between the two walls above the top surface of the upper wing, the process further comprises the step of covering the assembly groove with a cap, the cap being detachably and/or replaceably attached to the pulling member without using press riveting.

In one embodiment, a chamber is disposed in the assembly groove and a locking opening is disposed in the upper wing between the two walls, the process further comprises the steps of disposing a locking lever having a pivot end and a locking prong in the assembly groove, and disposing a plate spring in the assembly groove, wherein the plate spring contacts the locking lever and exerts a force on the locking lever, wherein the locking lever is so configured that the pivot end is disposed in the chamber and the locking prong penetrates the locking opening to be disposed between two zipper teeth when the pull tab is in a resting state, and the locking prong is lifted against the force exerted by the plate spring to disengage from the zipper teeth when a pulling force is exerted on the pull tab.

In the present invention, the substantially closed aperture means that the aperture of the wall may be completely closed, or the wall may have a traverse opening on its top through which the pintle of the pull tab can be inserted into the aperture(s) of the wall(s). For the latter, the size of the opening is so designed that the pintle of the pull tab can be inserted through the traverse opening into the aperture(s) of the wall(s), but the wall(s) would receive the whole pulling force exerted by the pulling tab when the pulling tab is pulled usually upwards or downwards. In case that there is provided a cap, the mounted cap will block the pintle of the pull tab so that the pintle of the pull tab will not fall out of the aperture(s) even if the wall(s) has a traverse opening on its top. In addition, in case that there exists no cap, the pintle may have an elastic plastic layer wrapped around the pintle so that the pintle can be pressed, because of the elastic compression of the wrapped plastic layer, into the aperture through the traverse opening of the wall, but it would not fall off after having been inserted into the aperture. Alternatively, the longitudinal direction of the traverse opening is not perpendicular to the longitudinal direction of the slider body so that the pull tab would not fall off after its pintle has been inserted into the aperture.

Other aspects of the present disclosure can be understood by those skilled in the art in light of the description, the claims, and the drawings of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
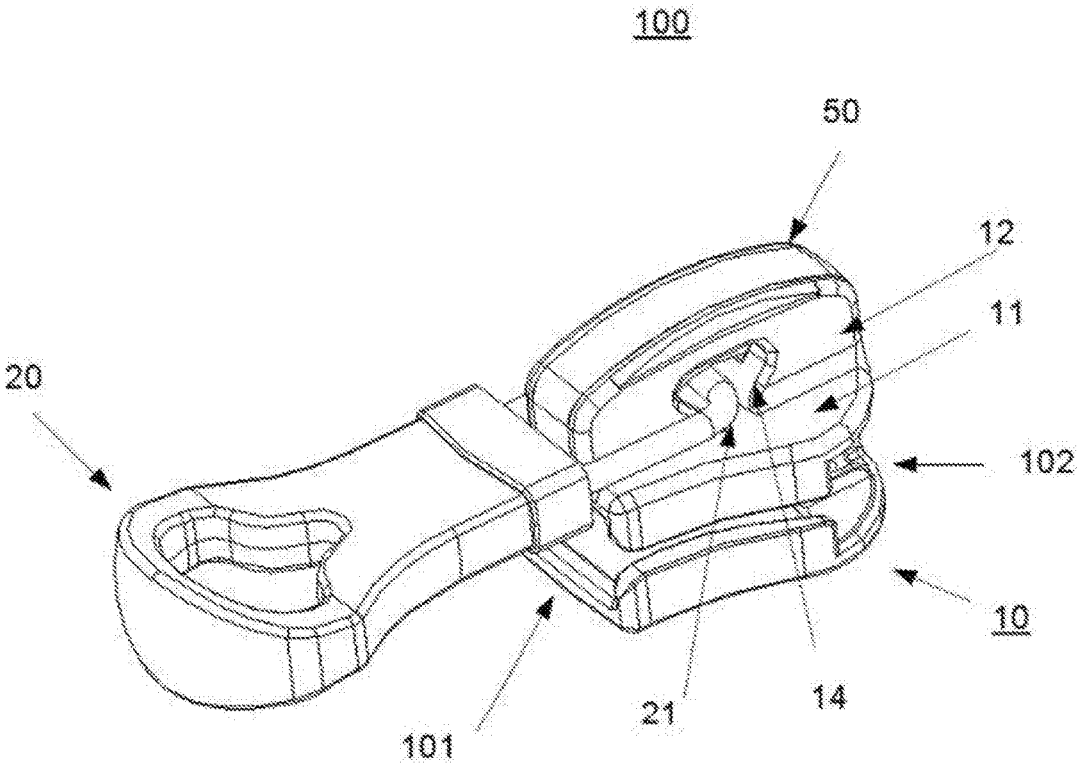
FIG. 1 illustrates an exemplary slider consistent with the disclosed embodiments.

FIG. 1 illustrates an exemplary slider 100 consistent with the disclosed embodiments. As shown in FIG. 1 the slider 100 includes a slider body 10 a pull tab 20, and a cap 50. The slider body 10 includes an upper wing 11, a front end 101, and a rear end 102. A pulling member 12 is disposed on the top surface of the upper wing 11. The pulling member 12 is integrated with the upper wing 11 The pulling member 12 is integrally formed, e.g. molded, with the upper wing 11. The pulling member 12 includes a transverse channel 14. The pull tab 20 has a pintle 21, which is disposed in the transverse channel 14.

Figure 2:
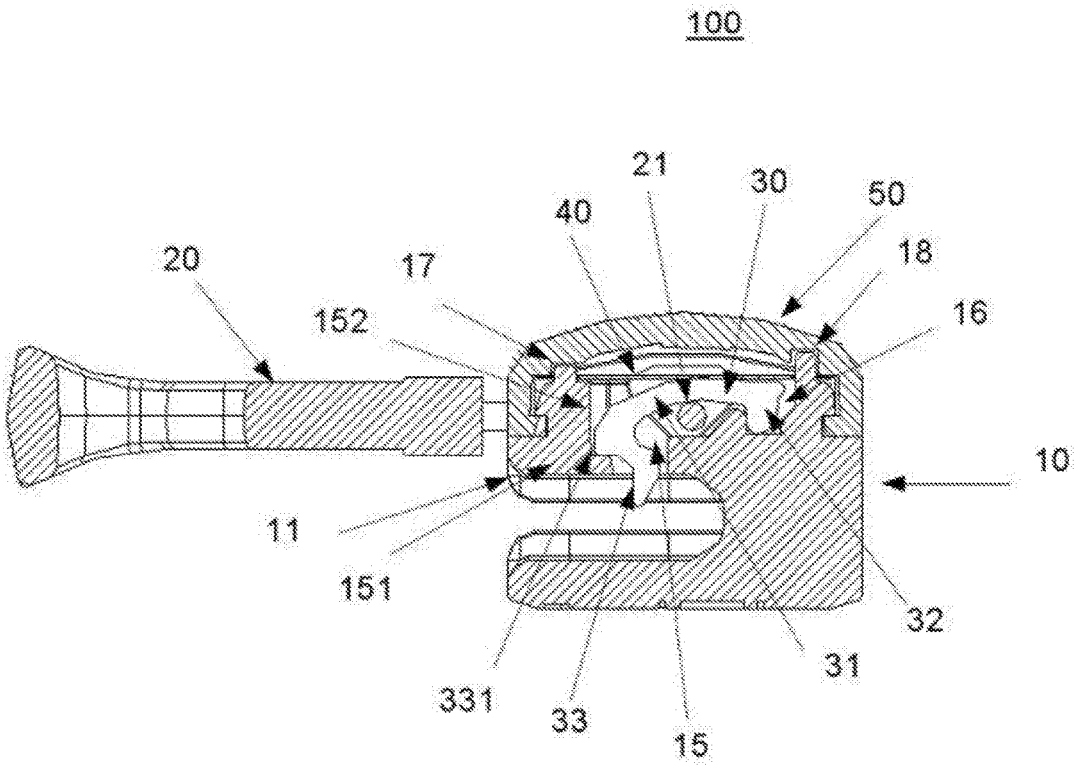
FIG. 2 illustrates a cross section view of an exemplary slider consistent with the disclosed embodiments.

FIG. 2 illustrates a cross section view of an exemplary slider 100 consistent with the disclosed embodiments. As shown in FIG. 2, the slider 100 includes a locking lever 30, and a plate spring 40. The slider 100 as shown in FIG. 2 is in a resting state. That is, the pull tab 20 is not pulled. The locking lever 30 does not receive an upward pulling force from the pull tab 20 transmitted through the pintle 21. The plate spring 40 may be configured to exert a force to press down the locking lever 30. Under the force, a locking prong 33 penetrates through a locking opening 15 in the upper wing 11 and is disposed between two zipper teeth, which are located within the slider body 10 (not shown). The zipper is thus locked in a position.

Figure 3:
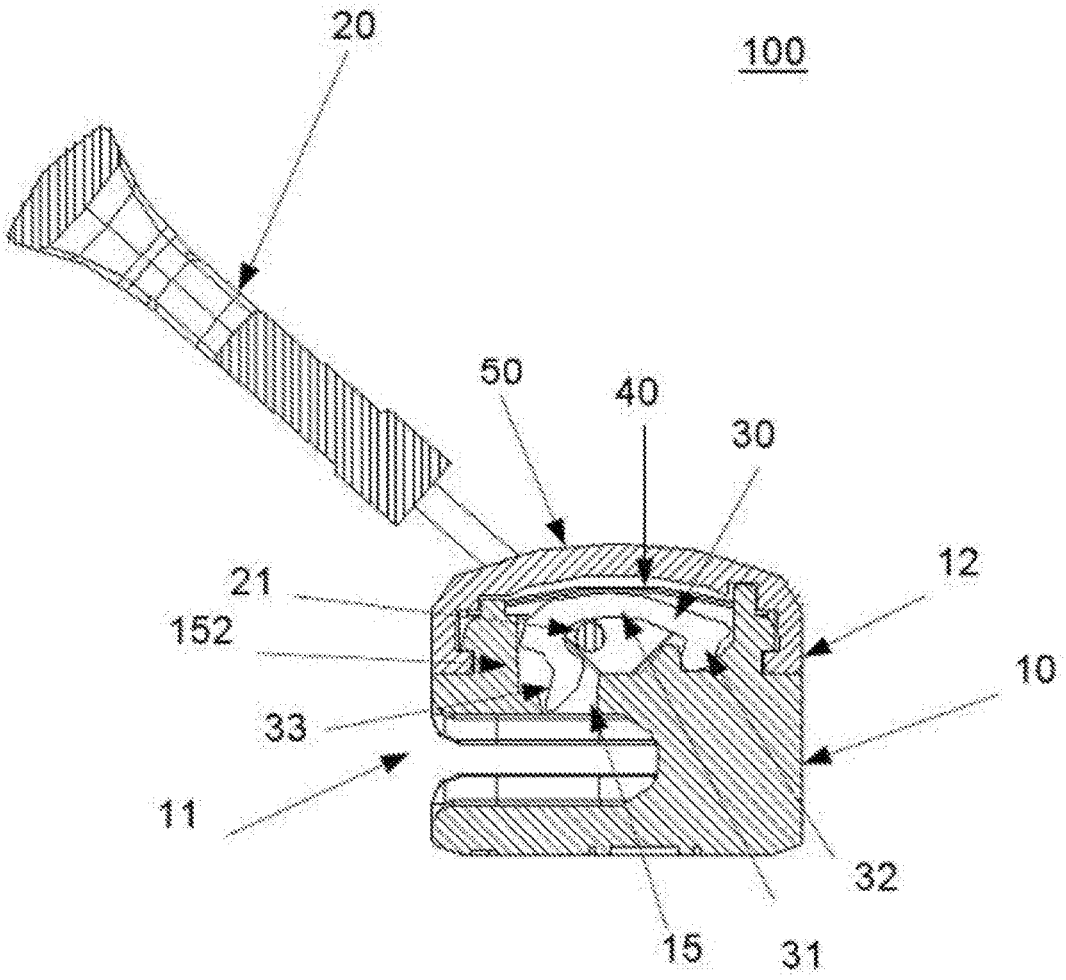
FIG. 3 illustrates a cross section view of an exemplary slider consistent with the disclosed embodiments.

FIG. 3 illustrates a cross section view of an exemplary slider 100 consistent with the disclosed embodiments. As shown in FIG. 3, the slider 100 is in a moving state. An upward pulling force is created when the pull tab 20 is pulled. The upward pulling force is transmitted to the locking lever 30 through the pintle 21. The locking lever 30 is lifted and pushes the plate spring 40 upwardly. The locking lever 30 moves upwardly under the upward pulling force. The locking prong 33 is lifted and disengages from the zipper teeth that are located within the slider body 10 (not shown). The slider 100 is released from the locking state and the slider may move along the zipper.

In a not shown embodiment, the spring plate a locking lever may also be omitted.

Figure 4:
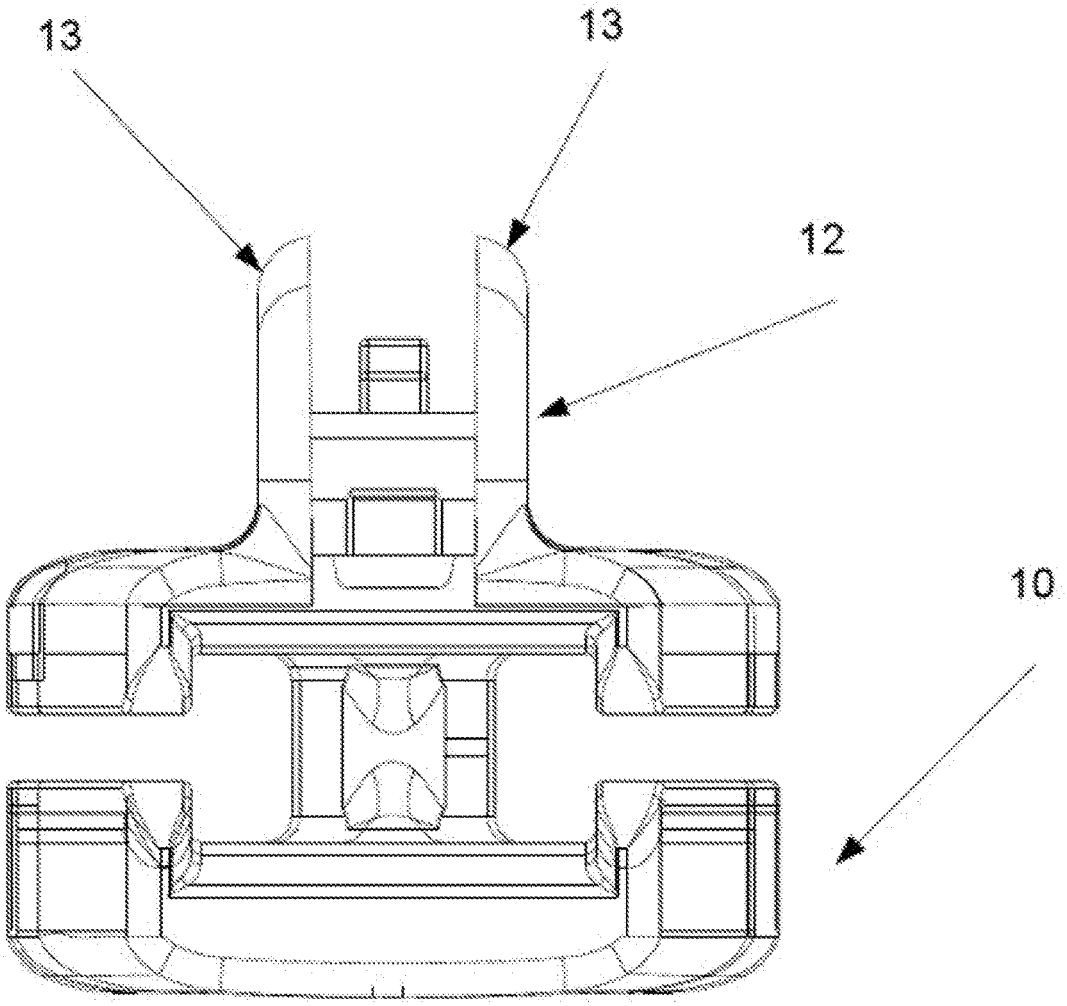
FIG. 4 illustrates a slider body with a pulling member of an exemplary slider consistent with the disclosed embodiments.

FIG. 4 illustrates the slider body 10 with the pulling member 12 of an exemplary slider 100 consistent with the disclosed embodiments. As shown in FIG. 4, the pulling member 12 includes two walls 13. The two walls 13 are longitudinally disposed on the top surface of the upper wing 11 of the slider body 10. The two walls 13 are permanently integrally formed on the upper wing 11 of the slide body 10. The two walls 13 may also have any appropriate shape and contour. In certain embodiments, the pulling member may also include only one wall or more than two walls. The slider body 10 and the pulling member 12 may be made of any appropriate metal or non-metal materials. The metal materials may include aluminum, steel, copper, or other metal materials. The non-metal materials may include plastic or any appropriate composite materials. The slider body 10 and the pulling member 12 may also be made of any appropriate combination of any appropriate materials.

Figure 5:
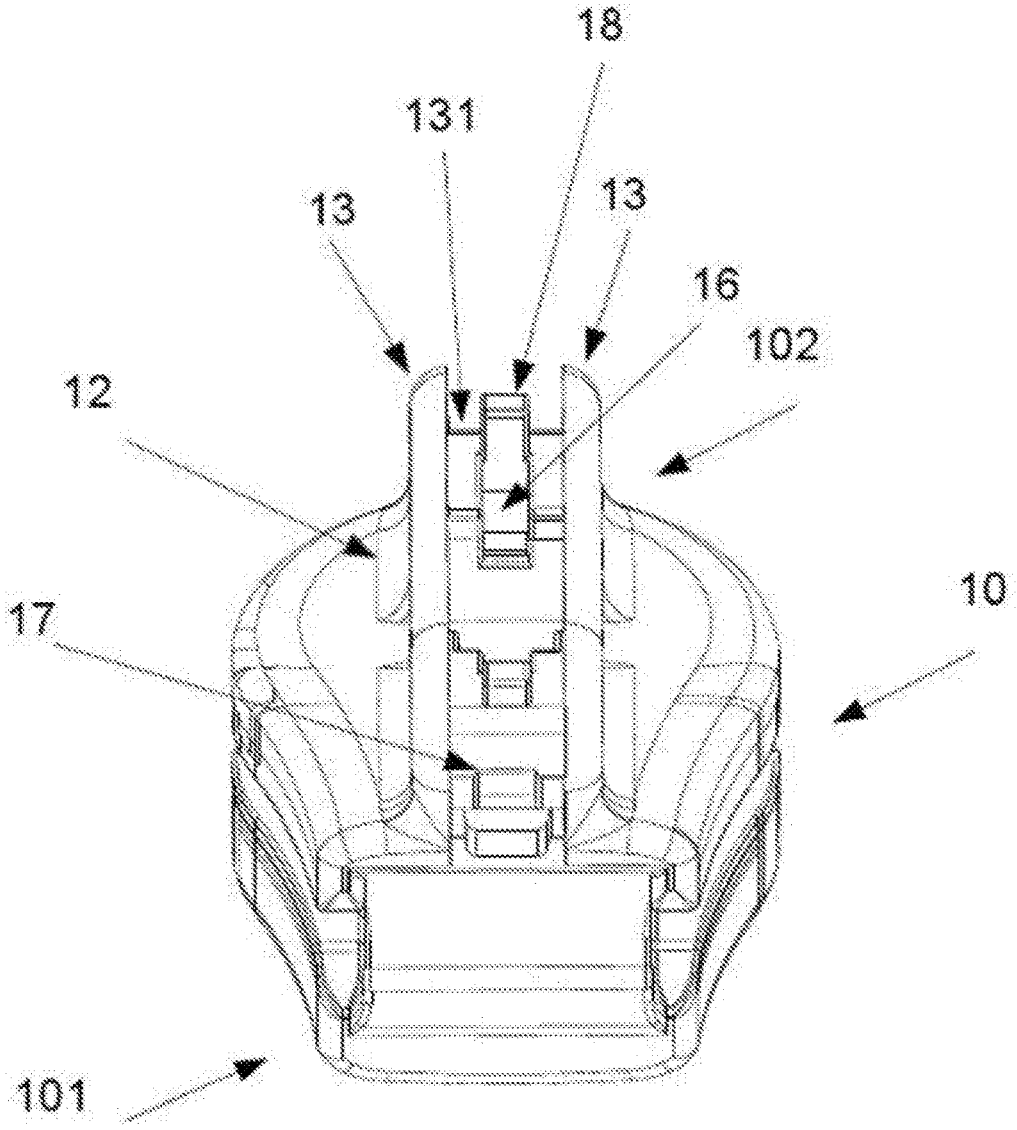
FIG. 5 illustrates a top view of a slider body with a pulling member of an exemplary slider consistent with the disclosed embodiments.

FIG. 5 illustrates a top view of the slider body 10 with the pulling member 12 of an exemplary slider 100 consistent with the disclosed embodiments. As shown in FIG. 5, an assembly groove 131 is longitudinally formed between the two walls 13. The two walls 13 may or may not be parallel to each other. A first protruding block 17 may be disposed in the groove 131 close to the front end 101 and a second protruding block 18 may be disposed in the groove 131 close to the rear end 102. A chamber 16 may be disposed anterior to the block 18.

Figure 6:
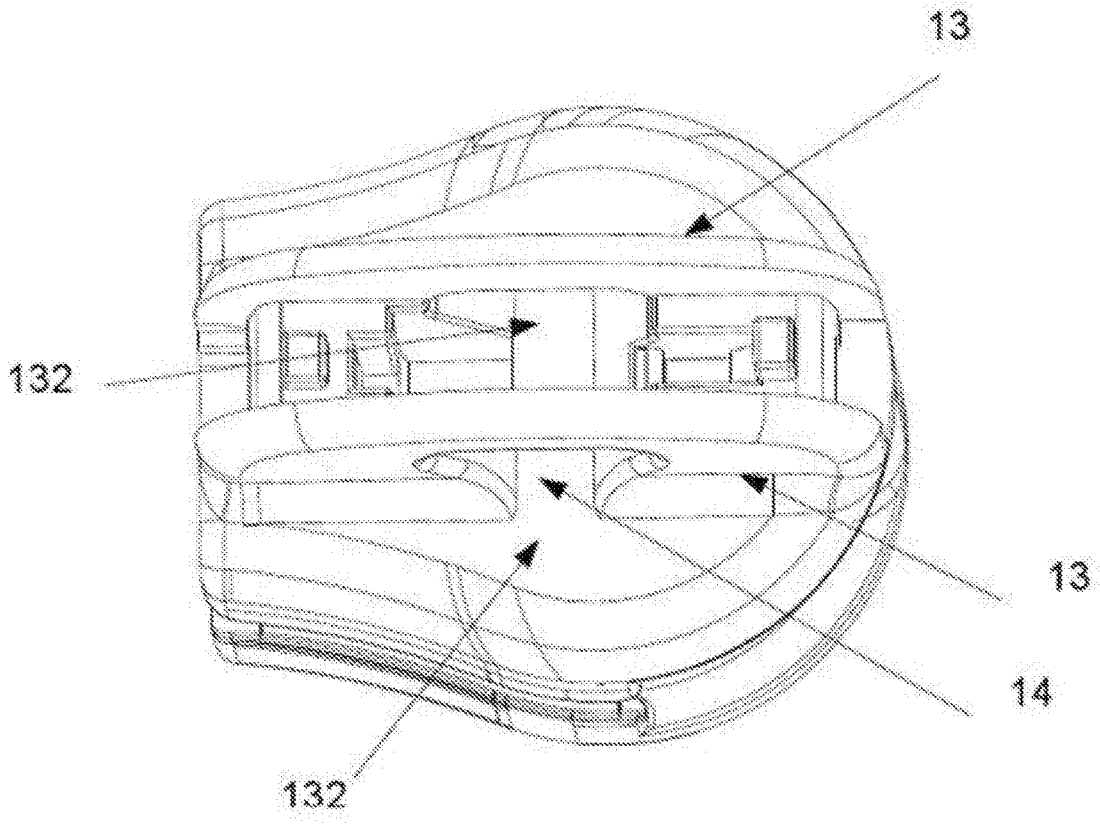
FIG. 6 illustrates a top view of a slider body with a pulling member of an exemplary slider consistent with the disclosed embodiments.

FIG. 6 illustrates a top view of the slider body 10 with the pulling member 12 of an exemplary slider 100 consistent with the disclosed embodiments. As shown in FIG. 6, a closed aperture 132 is formed through a wall 13. The two closed apertures 132 through the walls 13 form the cross channel 14. The apertures 132 may be in any appropriate position. In certain embodiments, the apertures 132 are located approximately in the middle of the walls 13.

Figure 7:
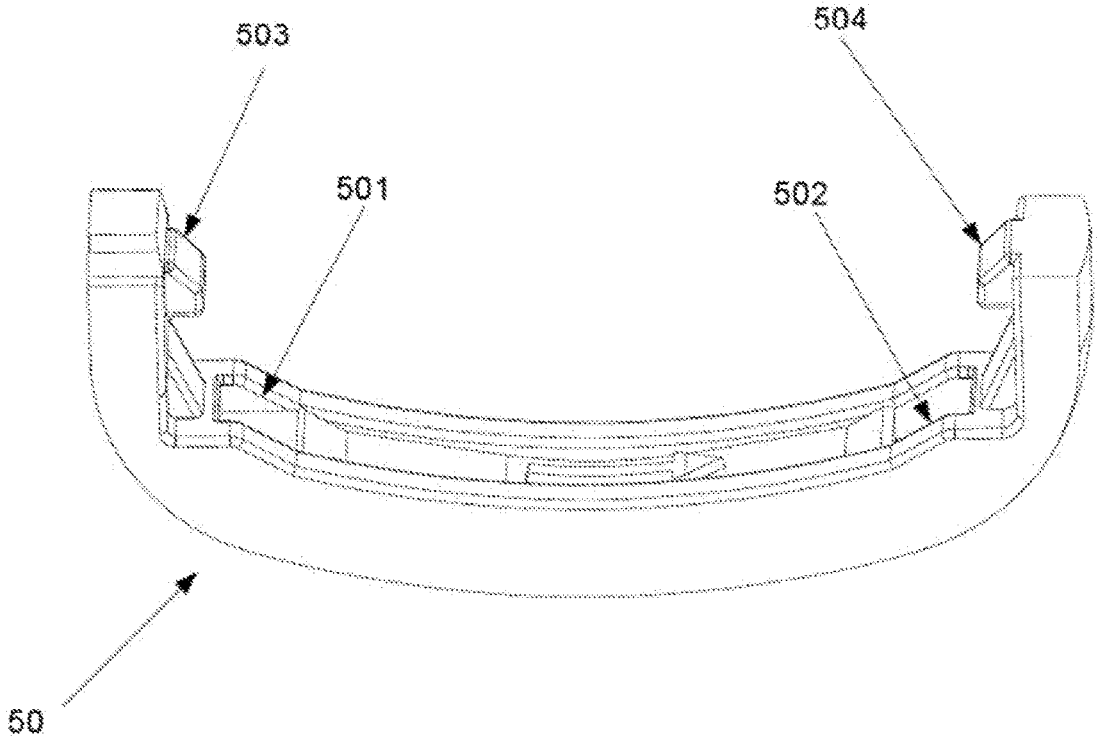
FIG. 7 illustrates a cap of an exemplary slider consistent with the disclosed embodiments.

FIG. 7 illustrates an exemplary cap 50 consistent with the disclosed embodiments. As shown in FIG. 7, the cap 50 may include a first receiving member 501 close to a first end and a second receiving member 502 close to a second end. The first receiving member 501 may correspond to the first protruding block 17 and the second receiving member 502 may correspond to the second protruding block 18. Thus, the receiving members 501 and 502 may allow the protruding block 17 and 18 to fit in the cap 50 for the cap 50 to cover the assembly groove 131. The cap 50 may also include a first attaching member 503 and a second attaching member 504.

Figure 8:
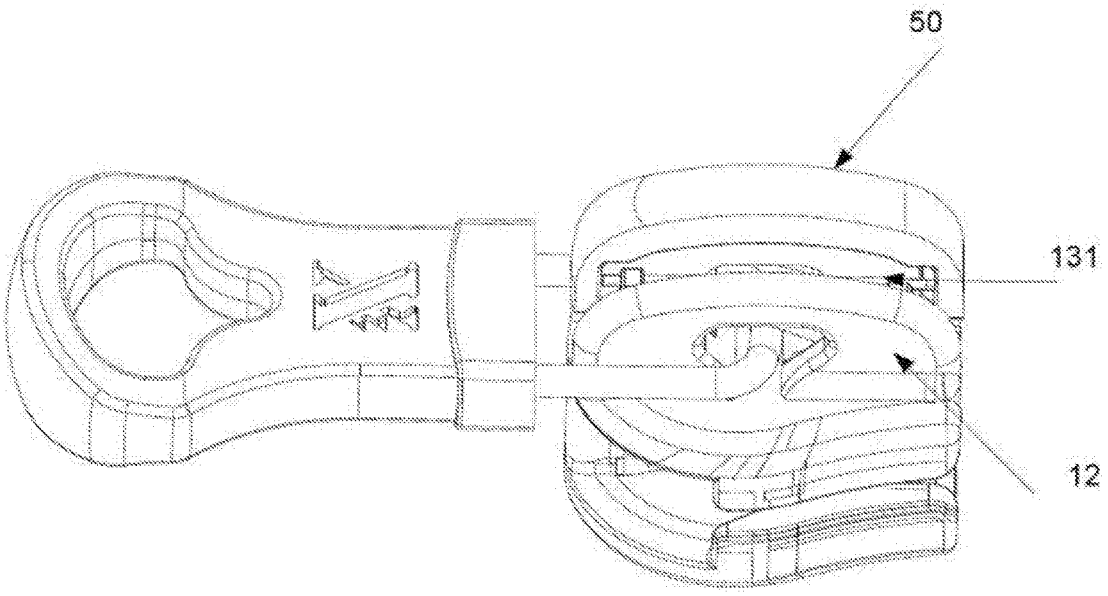
FIG. 8 illustrates an exemplary slider consistent with the disclosed embodiments.

FIG. 8 illustrates an exemplary slider 100 consistent with the disclosed embodiments. As shown in FIG. 8, the cap 50 may be attached to the pulling member 12 to enclose the assembly groove 131. The cap 50 may be removably attached to the pulling member 12. A user may remove a cap 50 on the slider body and attach another cap 50. Thus, a user may obtain one or more replacement caps 50 with the same or different exterior. A user may choose a replacement cap 50 to attach to the slider body 10 for any appropriate purpose. For example, a user may attach a replacement cap 50 for different look of the slider. The cap 50 may also be permanently fixed to the pulling member.

As shown in FIGS. 2 and 3, the slider 100 may be in a resting or moving state. In the resting state, the pull tab 20 does not receive pulling force and does not transmit pulling force to the slider body. In the moving state, the pull tab 20 transmits the pulling force to the slider body 10. Returning to FIG. 8, the pintle 21 is disposed in the channel 14 and may transmit the pulling force to the pulling member 12. The walls 13 of the pulling member 12 receive the pulling force and the cap 50 is configured not to receive the pulling force.

Figure 9:
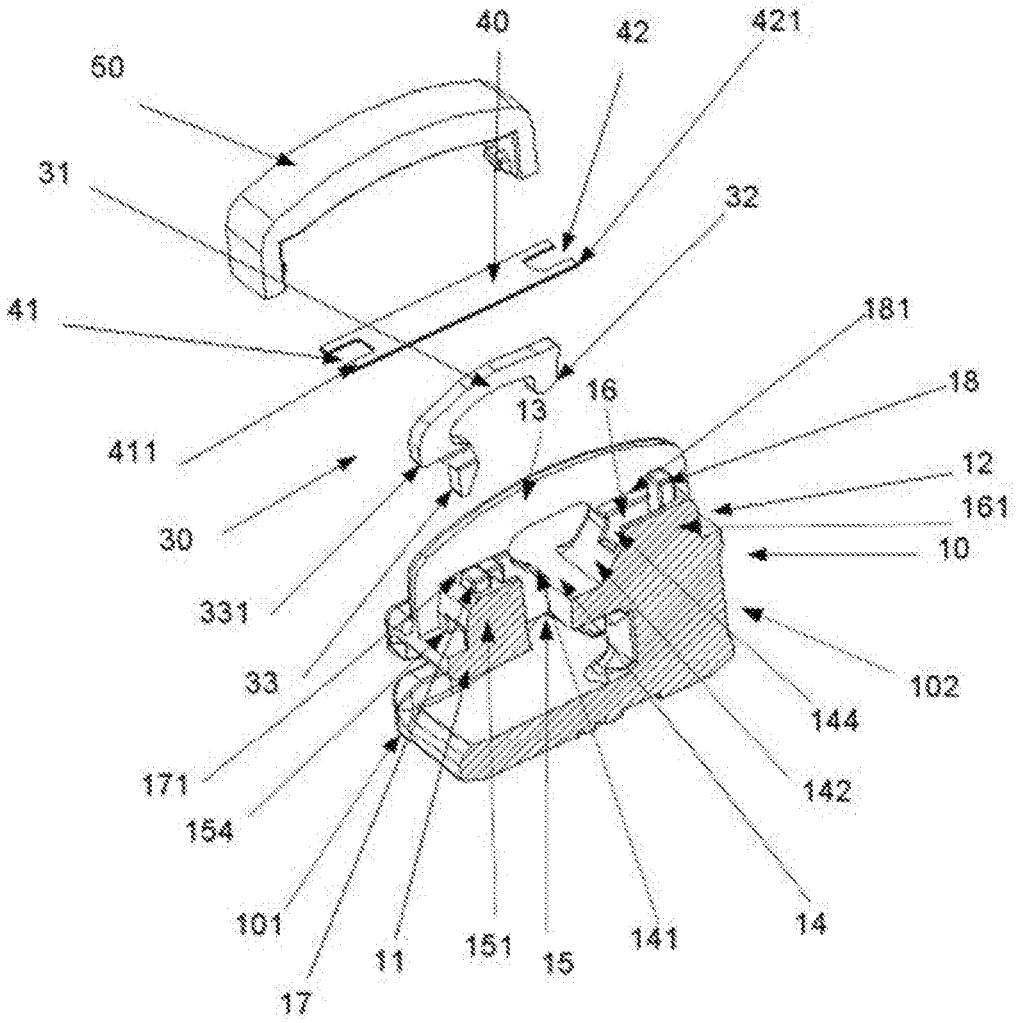
FIG. 9 illustrates an exploded view of a slider body with a pulling member of an exemplary slider consistent with the disclosed embodiments.

FIG. 9 illustrates an exploded view of the slider body 10, pulling member 12 and cap 50 of an exemplary slider 100 consistent with the disclosed embodiments. As shown in FIG. 9, a front platform 151 may be disposed close to the front end 101 and a rear platform 161 may be disposed close to the rear end 102 in the groove 131. A first receiving structure 154 may be disposed on the front platform 151, and a second receiving structure 156 may be disposed on the rear platform 161. In certain embodiments, the first receiving structure 154 may be a recess on the wall of the platform 151 at the front end 101 and for the second receiving structure 156 may be a recess on the wall of the platform 161 at the rear end 102. When the slider 100 is assembled, the first receiving structure 154 and/or the second receiving structure 156 may interact with the first attaching member 503 and/or the second attaching member 504 to attach or snap the cap 50 to the pulling member 12.

The first protruding block 17 may be disposed on the platform 151, and the second protruding block 18 may be disposed on the platform 161. The transverse dimension of the block 17 and the block 18 may be smaller than that of the platform 151 and the platform 161, respectively. Thus, a first sliding groove 171 may be formed between the block 17 and the wall 13, and a second sliding groove 181 may be formed between the block 18 and the wall 13.

As shown in FIG. 9, the channel 14 has a first cross transverse wall 141 and a second transverse wall 142. The wall 141 is on the platform 151 and the wall 142 is on the platform 161. The cross section of the channel 14 and the aperture 132 may be in any appropriate shape. In certain embodiments, the first and second cross transverse walls 141 and 142 of the channel 14 incline outwardly from the bottom to the top. The cross section of the channel 14 may thus have a small bottom and a larger top.

The slider 100 may include the locking opening 15. The opening 15 penetrates the upper wing 11 and the platform 151 vertically. The middle section of the wall 141 may be removed to accommodate the opening 15. The slider 100 may also include the chamber 16. The chamber 16 may be disposed within the platform 161. The chamber 16 may be formed by removing certain portion of the platform anterior to the block 18. The chamber 16 is connected to the channel 14 through an opening 144 on the wall 142.

The locking lever 30 includes a lever body 31. In certain embodiments, the lever body 31 may be curved. As shown in FIG. 9, the lever body 31 is curved outwardly. The locking lever 30 may include a pivot end 32 towards the rear end 102 and a positioning component 331 towards the front end 101. The positioning component 331 may be connected to a locking prong 33.

As shown in FIGS. 2 and 3, the locking lever 30 may be configured to dispose the pivot end 32 in the chamber 16 after the slider 100 is assembled. The positioning component 331 may be configured to be against a wall 152. The locking prong 33 may thus be configured to move vertically in the opening 15.

Returning to FIG. 9, the plate spring 40 is an elastic structure that is configured to be disposed on the top of the locking lever 30. The plate spring 40 may be in any appropriate shape. In certain embodiments, the plate spring 40 is an elongated rectangular plate. In certain embodiments, the plate spring 40 may include a first receiving groove 41 at the end close to the front end 101 and a second receiving groove 42 at the end close to the rear end 102. The receiving groove 41 may match the contour of the block 17 and the receiving groove 42 may match the contour of the block 18. Thus, when the spring 40 is placed on top of the platform 151 and the platform 161, the block 17 may contact the receiving groove 41 and the block 18 may contact the receiving groove 42. The spring 40 may maintain its position by the interaction between the receiving grooves 41 and 42 and the blocks 17 and 18 respectively. The plate spring 40 may be made of any appropriate material, such as elastic steel.

The transverse dimension of the receiving grooves 41 and 42 may be similar to that of the block 17 and 18 respectively, and the transverse dimension of the spring 40 at the two ends may be similar to that of the platform 151 and 161 respectively. Thus, a first sliding portion 411 and a second sliding portion 421 may fit into the sliding groove 171 and 181 respectively. The sliding portions 411 and 421 may slide on the sliding groove 171 and 181 respectively. As shown in FIG. 3, when the pull tab 20 is pulled, the plate spring 40 receives the pushing force from the locking lever 30. The sliding portions 411 and 421 slide inwardly on the sliding groove 171 and 181 and the plate spring 40 bends upwardly. When the pulling force on the pull tab 20 is removed, the sliding portions 411 and 421 may slide outwardly on the sliding groove 171 and 181, respectively.

Figure 10:
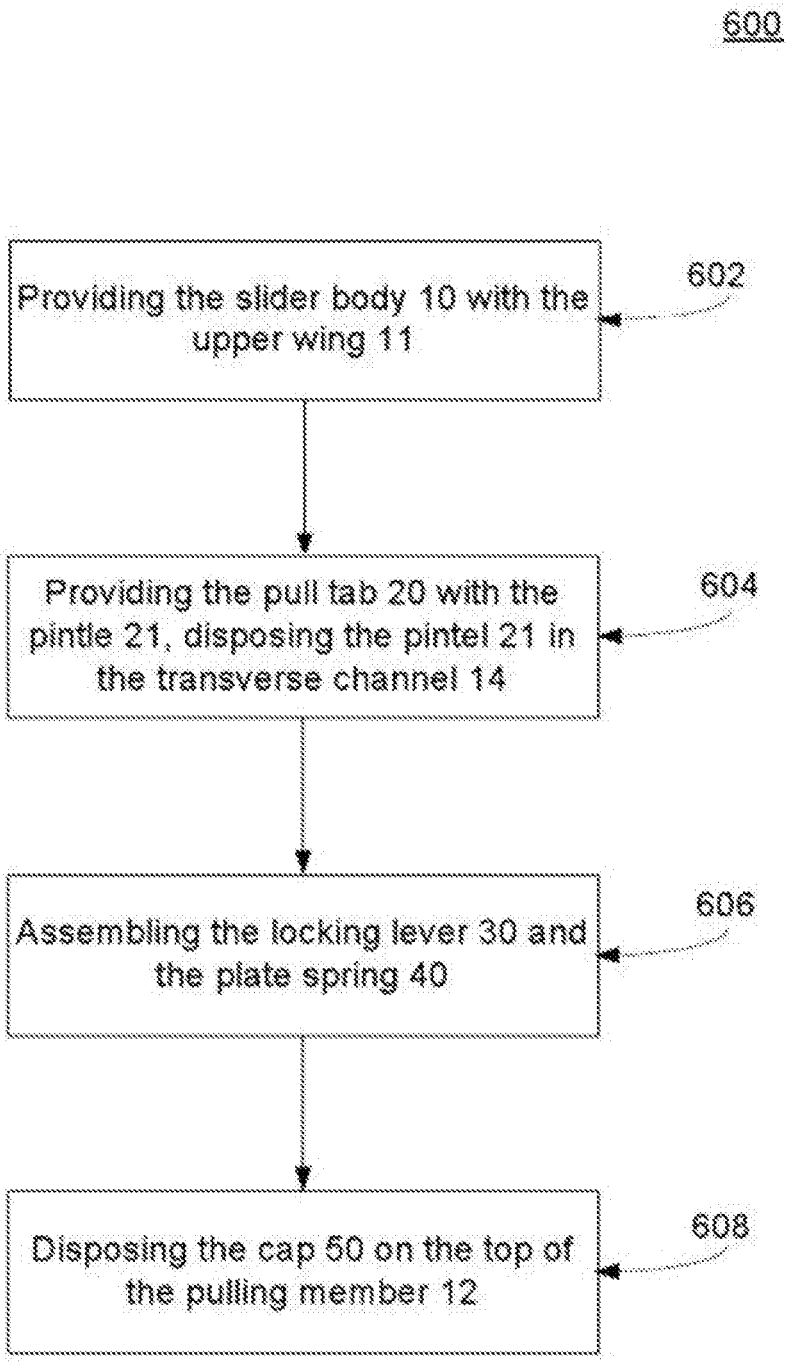
FIG. 10 illustrates an exemplar process for making an exemplary slider consistent with the disclosed embodiments.

FIG. 10 illustrates an exemplary process 600 of making an exemplary slider 100 consistent with the disclosed embodiments. As shown in FIG. 10, the slider body 10 with the upper wing 11 is provided (602). The pulling member 12 with two walls 13 is integrated on the upper wing 11. The walls 13 each have a closed aperture 132 and the two closed apertures 132 through the walls 13 form the transverse channel 14. The two walls 13 form the assembly groove 131. The pull tab 20 with the pintle 21 is provided and the pintle 21 is disposed in the transverse channel 14 (604). The locking lever 30 and the plate spring 40 may be assembled within the assembly groove 131 (606). The cap 50 is disposed on the top of the pulling member 12 to enclose the locking lever 30 and the plate spring 40 within the assembly groove 131 (608).

The process 600 may be completed without using press riveting. The pull tab 20 may be directly disposed in the pulling member 12. In addition, the assembly groove 131 is formed on the pulling member 12. The locking lever 30 and the plate spring 40 may be disposed in the groove 131 by insertion. The cap 50 may be attached on the groove 131 to enclose the locking lever 30 and the plate spring 40. The whole process 600 is quick and convenient. Thus, the efficiency of making the slider 100 is improved. The process 600 may be completed manually or automatically by an assembly device.

While various embodiments in accordance with the present invention have been shown and described, it is understood that the invention is not limited thereto. The present invention may be changed modified and further applied by those skilled in the art. Therefore, this invention is not limited to the details shown and described previously, but also includes all such changes and modifications. For example, in the above shown embodiments, the apertures are closed. However, the wall may have a traverse opening on its top through which the pintle of the pull tab can be inserted into the aperture of the wall, as long as the wall would receive the whole pulling force when the pull tab is pulled and the magnitude of the bearable pulling force of the wall would not be impaired by this traverse opening. In addition, the size, shape, and appearance of slider according to the present disclosure may be changed to adjust the use of the slider on different items.

A slider consistent with the disclosed embodiments may offer several benefits. A slider consistent with the disclosed embodiments includes a pulling member with two walls on an upper wing of a slider body and a pull tab is directly disposed within the pulling member. Because the pulling force may be directly exerted on the walls, the pulling member may bear large force. Further, the pulling member with two walls may be integrated with the upper wing and may bear greater force transmitted through the pull tab. Thus, a user may pull the pull tab with greater force.

Further, an assembly groove is formed on the pulling, member and a locking lever and a plate spring may be assembled within the assembly groove. A cap covers the assembly groove and encloses the locking lever and the plate spring within the slider. The assembly of the slider body may not need press riveting and the assembly process is convenient and efficient. The manufacturing efficiency is thus improved.

Related Testing Data

1. Some tests show that in a traditional cover-riveted type zipper slider, the composite pulling force of the slider body and the pull tab is not stable due to the riveting structure. For example, as shown in the following table, for 3# zinc alloy zipper slider, the difference between the composite pulling forces of sample 1 and sample 3 is 120.07 N. Herein, the composite pulling force of the slider body and the pull tab can be understood as a riveting force, i.e. a test pulling force that is applied to the riveted cover by pulling the pintle of the pull tab until the cover is detached from the pull member, wherein Rm is a maximum force.

| Nr | Rm (N) | Test Specification |
|---|---|---|
| 1 | 186.42 | composite pulling force |
| 2 | 225.55 | composite pulling force |
| 3 | 306.49 | composite pulling force |
| 4 | 204.78 | composite pulling force |
| 5 | 262.65 | composite pulling force |

2. Some tests show that in the inventive automatic-locking integral-structure type zipper slider, the composite pulling force of the slider body and the pull tab is more stable due to the integral structure, when compared to the traditional zipper slider having the riveted cover. For example, as shown in the following table, for 5# zinc alloy zipper slider, the composite pulling force of the slider body and the pull tab is stable. Herein, the composite pulling force of the slider body and the pull tab can be understood as a tensile strength force of the pull member of the integral structure type zipper slider, wherein Rm is a maximum force.

| Nr | Rm (N) | Test Specification |
|---|---|---|
| 1 | 515.05 | composite pulling force |
| 2 | 525.86 | composite pulling force |
| 3 | 527.86 | composite pulling force |
| 4 | 511.95 | composite pulling force |
| 5 | 528.96 | composite pulling force |

3. Some tests shove that in he inventive automatic-locking integral-structure type zipper slider, the zipper slider or the pulling member can bear a substantially increased pulling force, when compared to the traditional cover-riveted type zipper. The following is a comparison test result table between the inventive automatic-locking integral-structure type zipper slider and the traditional cover-riveted type zipper slider.

| Slider body | Zipper type | 1 | 2 | 3 | 4 | 5 | Test result |
|---|---|---|---|---|---|---|---|
| traditional cover-riveted type | 3# | 186.42 | 225.55 | 306.49 | 204.78 | 262.65 | Cover falling off |
| | 5# | 505.05 | 528.86 | 467.86 | 501.95 | 521.03 | Cover falling off |
| | 8# | 562.23 | 560.96 | 549.32 | 552.12 | 523.21 | Cover falling off |
| automatic-locking integral-structure type | 3# | 327.66 | 318.6 | 337.26 | 359.45 | 342.15 | Pull tab broken |
| | 5# | 515.05 | 525.86 | 527.86 | 511.95 | 528.96 | Pull tab broken |
| | 8# | 666.3 | 642.73 | 775.65 | 667.21 | 671.23 | Pull tab broken |

In the pulling force tests, the above pulling forces (items 1-5) for the traditional cover-riveted, automatic-locking zipper slider cause its cover to drop off or fall off. However, the above greater pulling forces (items 1-5) for the inventive automatic-locking integral-structure type zipper slider cause its pull tab to break, but the walls and the cap are not damaged. Thus, the present invention removes the risk of the cover falling off and increases the endurable breaking pulling force of the pulling member.

We claim:

1. A zipper slider, comprising:

a slider body configured to slide along a zipper, the slider body having an upper wing with a top surface;

a pulling member integrally formed with the upper wing, wherein the pulling member includes two opposite walls longitudinally extending from the top surface of the upper wing; an assembly groove is longitudinally formed between the two opposite walls on the top surface of the upper wing; a pair of closed apertures are formed on each of the two opposite walls of the pulling member; and a transverse channel is formed by the pair of closed apertures on the two opposite walls of the pulling member;

a pull tab with a pintle, wherein the pintle is positioned in the transverse channel; and a cap detachably and replaceably attached to the pulling member;

wherein a first receiving structure is disposed in a first platform close to a front end of the assembly groove, and a second receiving structure is disposed in a second platform close to a rear end of the assembly groove; a first attaching member and a second attaching member are disposed at opposite ends of the cap; and the first attaching member and the second attaching member of the cap engage with the first receiving structure and the second receiving structure, respectively in a longitudinal direction that is parallel to the two opposite walls, so that the cap is positioned on the pulling member in snap fit along edges of the two opposite walls of the pulling member to cover the assembly groove without overlapping the two opposite walls of the pulling member.

2. The zipper slider according to claim 1, further comprising:

a locking lever having a pivot end and a locking prong;

a plate spring, wherein the plate spring contacts the locking lever and exerts a force on the locking lever;

a chamber disposed in the assembly groove; and a locking opening in the upper wing between the two opposite walls; wherein the locking lever is so configured that the pivot end is disposed in the chamber and the locking prong penetrates the locking opening to be disposed between two zipper teeth when the pull tab is in a resting state, and the locking prong is lifted against the force exerted by the plate spring to disengage from the zipper teeth when a pulling force is exerted on the pull tab.

3. The slider according to claim 1, further comprising:

a first protruding block disposed on the first platform;

a second protruding block disposed on the second platform;

a first receiving member on the cap corresponding to the first protruding block; and a second receiving member on the cap corresponding to the second protruding block.

4. The slider according to claim 1, wherein the traverse channel has a first cross transverse wall and a second cross transverse wall inclining outwardly from the bottom to the top so that the traverse channel has a cross section with a small bottom and a larger top.

* * * * *